US008491358B2

(12) United States Patent
Sung

(10) Patent No.: US 8,491,358 B2
(45) Date of Patent: Jul. 23, 2013

(54) THIN FILM BRAZING OF SUPERABRASIVE TOOLS

(76) Inventor: Chien-Min Sung, Tansui (TW)

( * ) Notice: Subject to any disclaimer, the term of this patent is extended or adjusted under 35 U.S.C. 154(b) by 780 days.

(21) Appl. No.: 12/650,782

(22) Filed: Dec. 31, 2009

(65) Prior Publication Data

US 2010/0190423 A1 Jul. 29, 2010

Related U.S. Application Data

(60) Provisional application No. 61/147,393, filed on Jan. 26, 2009.

(51) Int. Cl.
*B24B 53/00* (2006.01)

(52) U.S. Cl.
USPC ..... 451/443; 51/309

(58) Field of Classification Search
USPC ..... 451/443, 444, 540; 51/293, 307, 51/308, 309, 295
See application file for complete search history.

(56) References Cited

U.S. PATENT DOCUMENTS 4,925,457 A * 5/1990 deKok et al. ..... 51/293
6,039,641 A 3/2000 Sung
6,286,498 B1 9/2001 Sung
6,368,198 B1 4/2002 Sung et al.
6,884,155 B2 * 4/2005 Sung et al. ..... 451/443

* cited by examiner

*Primary Examiner* — Robert Rose
(74) *Attorney, Agent, or Firm* — Thorpe North & Western LLP

(57) ABSTRACT

Methods for orienting superabrasive particles in a superabrasive tool are provided. In one aspect, for example, a method for orienting superabrasive particles in a tool is provided. Such a method can include providing a plurality of superabrasive particles having a preselected average size, preselecting a thickness for an amorphous braze layer to be applied to a substrate, wherein the thickness is based on the average size of the plurality of superabrasive particles, and applying an amorphous braze layer to the substrate at the preselected thickness. The method can further include dispersing the plurality of superabrasive particles onto the amorphous braze layer, and melting the amorphous braze layer to cause the plurality of superabrasive particles to rotate and sink into the amorphous braze layer, wherein the thickness of the amorphous braze layer is such that the rotation and sinking of the plurality of superabrasive particles is halted by the substrate in an attitude whereby substantially all working ends of the plurality of superabrasive particles are sharp portions. The amorphous braze layer can then be cooled to fix the plurality of superabrasive particles into the tool.

20 Claims, 1 Drawing Sheet

THIN FILM BRAZING OF SUPERABRASIVE TOOLS

PRIORITY DATA

This application claims the benefit of U.S. Provisional Patent Application Ser. No. 61/147,393, filed on Jan. 26, 2009, which is incorporated herein by reference.

FIELD OF THE INVENTION

The present invention relates generally to devices and methods for use in connection with dressing or conditioning a chemical mechanical polishing (CMP) pad. Accordingly, the present invention involves the chemical and material science fields.

BACKGROUND OF THE INVENTION

Chemical mechanical process (CMP) has become a widely used technique for polishing certain work pieces. Particularly, the computer manufacturing industry has begun to rely heavily on CMP processes for polishing wafers of ceramics, silicon, glass, quartz, metals, and mixtures thereof for use in semiconductor fabrication. Such polishing processes generally entail applying the wafer against a rotating pad made from a durable organic substance such as polyurethane. To the pad is added a chemical slurry containing a chemical solution capable of breaking down the wafer substance and an amount of abrasive particles which act to physically erode the wafer surface. The slurry is continually added to the spinning CMP pad, and the dual chemical and mechanical forces exerted on the wafer cause it to be polished in a desired manner.

Of particular importance to the quality of polishing achieved, is the distribution of the abrasive particles throughout the pad. The top of the pad holds the particles, usually by a mechanism such as fibers, or small pores, which provide a friction force sufficient to prevent the particles from being thrown off of the pad due to the centrifugal force exerted by the pad's spinning motion. Therefore, it is important to keep the top of the pad as flexible as possible, and to keep the fibers as erect as possible, or to assure that there are an abundance of openings and pores available to receive new abrasive particles.

A problem with maintaining the top of the pad is caused by an accumulation of polishing debris coming from the work piece, abrasive slurry, and dressing disk. This accumulation causes a "glazing" or hardening of the top of the pad that mats the fibers down, thus making the pad less able to hold the abrasive particles of the slurry, and thus significantly decreases the pad's overall polishing performance. Further, with many pads the pores used to hold the slurry become clogged, and the overall asperity of the pad's polishing surface becomes depressed and matted. Therefore, attempts have been made to revive the top of the pad by "combing" or "cutting" it with various devices. This process has come to be known as "dressing" or "conditioning" the CMP pad. Many types of devices and processes have been used for this purpose. One such device is a disk with a plurality of super hard crystalline particles, such as diamond particles attached to a surface, or substrate thereof.

Yet another disadvantage with modern CMP pad dressers is reduced life of the pad conditioner and CMP pad. As noted, abrasive particles and CMP pads can wear out prematurely when the particles cut too deeply into the pad and consume the pad unnecessarily. Such premature wear reduces the ability of the CMP pad dresser to effectively polish the work piece. When functioning optimally, the abrasive particles act to refurbish the asperities in the CMP pad, and thus create an optimal polishing environment.

The rate at which a CMP pad is dressed may affect the surface roughness of the pad, which in turn may determine the amount of slurry held on the surface and thus affect polishing rate. In general, the polishing rate of the wafer is proportional to the dressing rate. However, if he dressing rate is excessive, the pad surface may become overly rough, and thus decrease the uniformity of the polished wafer. As such, optimizing the dressing rate may improve polishing rate without adversely affecting the quality of the wafer.

In view of the foregoing, it is desirable to obtain CMP pad dressers and methods configured to control dresser performance in order to achieve optimal dressing results, with maximized efficiency and lifespan for various applications.

SUMMARY OF THE INVENTION

Accordingly, in one aspect, the present invention provides superabrasive tools having oriented superabrasive particles held to a substrate by a thin braze layer and related methods. In one aspect, for example, a method for orienting superabrasive particles in a tool is provided. Such a method can include providing a plurality of superabrasive particles having a preselected average size, preselecting a thickness for an amorphous braze layer to be applied to a substrate, wherein the thickness is based on the average size of the plurality of superabrasive particles, and applying an amorphous braze layer to the substrate at the preselected thickness. The method can further include dispersing the plurality of superabrasive particles onto the amorphous braze layer, and melting the amorphous braze layer to cause the plurality of superabrasive particles to rotate and sink into the amorphous braze layer, wherein the thickness of the amorphous braze layer is such that the rotation and sinking of the plurality of superabrasive particles is halted by the substrate in an attitude whereby substantially all working ends of the plurality of superabrasive particles are sharp portions. The amorphous braze layer can then be cooled to fix the plurality of superabrasive particles into the tool.

The amorphous braze layer is of a thickness that allows the rotation and sinking of the superabrasive particles into a particular attitude. The thickness of the amorphous braze layer is thus related to the size of the superabrasive particles. For example, in one aspect, the thickness of the amorphous braze layer is less than ⅓, or about ⅓ the average diameter of the plurality of superabrasive particles. In another aspect, the thickness of the amorphous braze layer is less than ⅓ and greater than ⅕ of the average diameter of the plurality of superabrasive particles. In yet another aspect, the thickness of the amorphous braze layer may be about ⅕ of the average diameter of the plurality of superabrasive particles.

In another aspect, the method can further include electrodepositing a protective layer on the amorphous braze layer. The thickness of the protective layer can vary widely, depending on the use of the superabrasive tool and the degree of exposure of the superabrasive particles that is desired. In a more specific aspect, the amorphous braze layer and the protective layer have an additive thickness that is less than or equal to ¾ of the average diameter of the plurality of superabrasive particles. In another more specific aspect, the amorphous braze layer and the protective layer have an additive thickness that is less than or equal to ½ of the average diameter of the plurality of superabrasive particles. Furthermore, any material that can be electrodeposited and provides some protection to the underlying amorphous braze can be utilized as a protective layer. One non-limiting example can include nickel.

In another aspect of the present invention, a superabrasive tool is provided. Such a tool can include a substrate and a plurality of superabrasive particles bonded to the substrate with an amorphous braze layer having a thickness that is less than or equal to ⅓ of an average diameter of the plurality of superabrasive particles, and wherein substantially all of the plurality of superabrasive particles has an attitude whereby working ends of the plurality of superabrasive particles are sharp portions. In one aspect, the thickness of the amorphous braze layer is also greater than ⅕ the average diameter of the plurality of superabrasive particles.

Any superabrasive material capable of being bonded to a substrate by an amorphous braze layer can be utilized as superabrasive particles. In one aspect, however, the plurality of superabrasive particles includes members selected from a group consisting of: diamond, polycrystalline diamond (PCD), cubic boron nitride (cBN), polycrystalline cubic boron nitride (PCBN), and combinations thereof. In another aspect, the plurality of superabrasive particles includes diamond.

The amorphous braze layer is of a thickness that allows superabrasive particles to align in a particular attitude during manufacture of the tool. In one aspect, for example, substantially all of the plurality of superabrasive particles are configured in an attitude having an apex portion oriented away from the substrate. In another aspect, substantially all of the plurality of superabrasive particles are configured in an attitude having an edge portion oriented away from the substrate. In yet another aspect, substantially all of the plurality of superabrasive particles are configured in an attitude having either an apex portion or an edge portion oriented away from the substrate.

The above-recited features and advantages of the present invention will become apparent from a consideration of the following detailed description presented in connection with the accompanying drawings.

DETAILED DESCRIPTION OF THE INVENTION

Figure 1A:
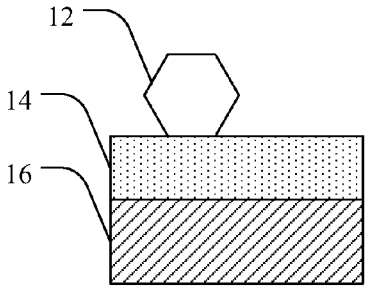
FIG. 1A (Prior Art)
FIGS. 1A-1C are side view depictions of a superabrasive particle rotating in a liquid braze layer in accordance with the prior art.

Before the present device and accompanying methods of use and manufacture are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to an "abrasive particle" includes reference to one or more of such abrasive particles.

Definitions

In describing and claiming the present invention, the following terminology will be used in accordance with the definitions set forth below.

As used herein, "superabrasive particles" and "superabrasive grit" or similar phrases may be used interchangeably, and refer to any natural or synthetic super hard crystalline, or polycrystalline substance, or mixture of substances and include but are not limited to diamond, polycrystalline diamond (PCD), cubic boron nitride (cBN), and polycrystalline cubic boron nitride (PcBN). Further, the terms "abrasive particle," "grit," "diamond," "polycrystalline diamond (PCD)," "cubic boron nitride," and "polycrystalline cubic boron nitride, (PcBN)," may be used interchangeably.

As used herein, "superhard" and "superabrasive" may be used interchangeably, and refer to a crystalline, or polycrystalline material, or mixture of such materials having a Vicker's hardness of about 4000 $Kg/mm^2$ or greater. Such materials may include without limitation, diamond, and cubic boron nitride (cBN), as well as other materials known to those skilled in the art. While superabrasive materials are very inert and thus difficult to form chemical bonds with, it is known that certain reactive elements, such as chromium and titanium are capable of chemically reacting with superabrasive materials at certain temperatures.

As used herein, "substrate" means a portion of a tool, such as a CMP dresser, which supports abrasive particles, and to which abrasive particles may be affixed. Substrates useful in the present invention may be any shape, thickness, or material, that is capable of supporting abrasive particles in a manner that is sufficient provide a tool useful for its intended purpose. Substrates may be of a solid material, a powdered material that becomes solid when processed, or a flexible material. Examples of typical substrate materials include without limitation, metals, metal alloys, ceramics, and mixtures thereof. Further the substrate may include brazing alloy material.

As used herein, "sharp portion" means any narrow portion to which a crystal may come, including but not limited to corners, ridges, edges, points, obelisks, and other protrusions. In one aspect, the sharp point may be an edge.

As used herein, "working end" refers to an end of a particle which is oriented towards the CMP pad and during a dressing operation makes contact with the pad. Most often the working end of a particle will be distal from a substrate to which the particle is attached.

As used herein, "amorphous braze" refers to a homogenous braze alloy composition having a non-crystalline structure. Such alloys contain substantially no eutectic phases that melt incongruently when heated. Although precise alloy composition is difficult to ensure, the amorphous brazing alloy as used herein should exhibit a substantially congruent melting behavior over a narrow temperature range.

As used herein, "alloy" refers to a solid or liquid mixture of a metal with a second material, where the second material can be a non-metal, such as carbon, a metal, or an alloy which enhances or improves the properties of the metal.

As used herein, "metal brazing alloy," "brazing alloy," "braze alloy," "brazing material," and similar terms may be used interchangeably, and refer to a metal alloy that is capable of chemically bonding to superabrasive particles, and to a matrix support material, or substrate, so as to substantially bind the two together. The particular braze alloy components and compositions disclosed herein are not limited to the particular embodiment disclosed in conjunction therewith, but may be used in any of the embodiments of the present invention disclosed herein.

As used herein, the process of "brazing" is intended to refer to the creation of chemical bonds between the atoms of a superabrasive particle and the braze layer. Further, "chemical bond" means a covalent bond, such as a carbide, nitride, or boride bond, rather than mechanical or weaker inter-atom attractive forces. Thus, when "brazing" is used in connection with superabrasive particles, a true chemical bond is being formed. However, when "brazing" is used in connection with metal to metal bonding the term is used in the more traditional sense of a metallurgical bond. Therefore, brazing of a superabrasive segment to a tool body does not require the presence of a carbide, nitride, or boride former.

As used herein, "metallic" means any type of metal, metal alloy, or mixture thereof, and specifically includes but is not limited to steel, iron, and stainless steel.

As used herein, "grid" means a pattern of lines forming multiple squares.

As used herein, "attitude" means the position or arrangement of a superabrasive particle in relation to a defined surface, such as a substrate to which it is attached, or a CMP pad to which it is to be applied during a work operation. For example, a superabrasive particle can have an attitude that provides a specific portion of the particle in orientation toward a CMP pad.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

The Invention

Figure 1B:
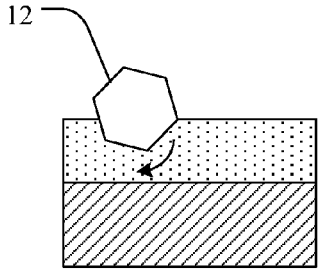
FIG. 1B (Prior Art)
Figure 1C:
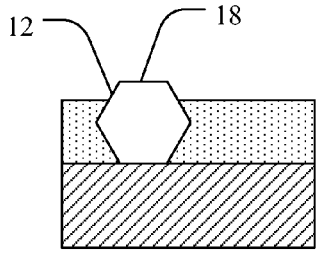
FIG. 1C (Prior Art)

The present invention provides superabrasive tools having oriented superabrasive particles held to a substrate by a thin braze layer and related methods. It has now been discovered that superabrasive particles disposed on a liquid molten braze to will rotate and sink in the braze due to capillary forces. Due to the thickness of molten brazes traditionally used in the prior art, the superabrasive particles rotate and come to rest with many of the particles having a flat face pointing face up. As is shown in FIG. 1A (prior art), a superabrasive particle 12 is disposed on a braze layer 14 that is resting on a substrate 16. FIG. 1B (prior art) shows the superabrasive particle 12 following liquefaction of the braze layer 14. The superabrasive particle rotates in the liquid braze layer as is shown. Thicker braze layers allow for more rotation as the superabrasive particle sinks. FIG. 1C (prior art) shows the superabrasive particle 12 embedded in the now solidified braze layer 14 with a face 18 oriented away from the substrate 16. Such a face up configuration does not penetrate a work piece such as a CMP pad very effectively.

Figure 2A:
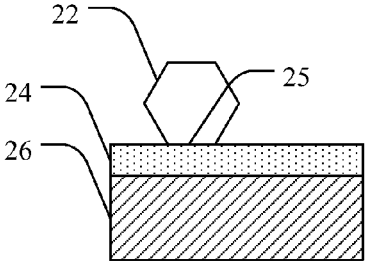
FIGS. 2A-2C are side view depictions of a superabrasive particle rotating in a liquid braze layer in accordance with one embodiment of the present invention.
Figure 2B:
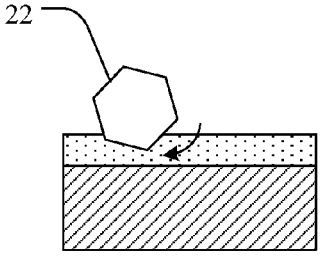
Figure 2C:
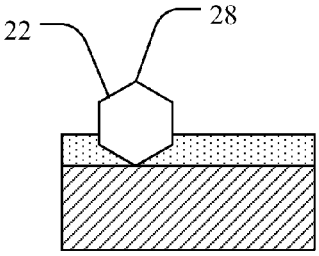

In many situations, it is preferable to have ether the edges or the tips of superabrasive particles oriented to function as working ends to more effectively penetrate and dress the pad. By limiting the thickness of the braze layer, the rotation of the superabrasive particles is also limited. As is shown in FIG. 2A, a superabrasive particle 22 is disposed on a braze layer 24 prior to liquefaction is primarily resting with a face 25 toward the braze layer. Upon liquefaction of the braze layer 24, as is shown in FIG. 2B, the superabrasive particle 22 will sink and rotate from this same resting position in a fairly uniform manner until impeded by the underlying substrate 26. FIG. 2C shows that the thickness of the braze layer 24 limits the rotation of the superabrasive particle 22 such that, in the case of FIG. 2C, a point 28 of the superabrasive particle 22 is oriented away from the substrate 26. Thus the limitation on the amount of rotation can facilitate the arrangement of a superabrasive particle having edges, points, or edges and points oriented away from the substrate in the finished tool.

Accordingly, in one aspect of the present invention, a method for orienting superabrasive particles in a tool is provided. Such a method can include dispersing a plurality of superabrasive particles on an amorphous braze layer, where the amorphous braze layer is disposed upon a substrate, melting the amorphous braze layer to cause the plurality of superabrasive particles to rotate and sink into the amorphous braze layer, wherein the amorphous braze layer is of a thickness such that the rotation and sinking of the plurality of superabrasive particles is halted by the substrate in an attitude whereby substantially all working ends of the plurality of superabrasive particles are sharp portions, and cooling the amorphous braze layer to form an amorphous braze layer.

The present invention additionally provides superabrasive tools according the various aspects presented herein. In one aspect, a superabrasive tool is provided having a substrate and a plurality of superabrasive particles bonded to the substrate with an amorphous braze layer having a thickness that is less than or equal to ⅓ of an average diameter of the plurality of superabrasive particles, and wherein substantially all of the plurality of superabrasive particles has an attitude whereby working ends of the plurality of superabrasive particles are sharp portions.

Thickness of the braze layer can vary depending on the size of the superabrasive particle and the rotation characteristics of the superabrasive particle in the specific braze layer. As a general rule of thumb, however, the thickness of the amorphous braze layer can be less than ⅓ the average diameter of the superabrasive particles. At the same time, sufficient braze needs to be surrounding the superabrasive particle to allow retention during abrading or dressing operations. While this minimum thickness is also variable depending on the various characteristics of the tool and the tool materials, the amorphous braze layer can be greater than ⅕ the average diameter of the plurality of superabrasive particles. It should be noted that braze layer wicking up the sides of superabrasive particles is not included in the thickness measurement, and as such, thicknesses should be measured at a sufficient distance from the superabrasive particles to avoid wicked material. Also, superabrasive particle retention in these thin braze layers can be improved by utilizing a protective layer, as is described more fully below.

Additionally, it is also contemplated that the viscosity of the braze layer can affect the rotation and sinking characteristics of the superabrasive particles. Accordingly, the viscosity of the braze layer can be adjusted or preselected to allow a specific rotation and sinking of the superabrasive particles into a preferred attitude. Such viscosity changes can be facilitated by additives to the braze alloy, by selecting particular alloy components, adjusting the temperature of the alloy in the liquid phase, etc.

Various types of superabrasive particles may be utilized in various aspects of the present invention. For example, in one aspect, such materials may include, diamond, polycrystalline diamond (PCD), cubic boron nitride (cBN), polycrystalline cubic born nitride (PcBN), and combinations thereof In some aspects, the superabrasive particles may include diamond. In another aspect, superabrasive particles can include SiC, $Al_2O_3$, Zr $O_2$, WC, and combinations thereof.

Furthermore, superabrasive particles can be of a predetermined shape. For example, superabrasive particles can be a euhedral shape or either a octahedral or cubo-octahedral shape. Although virtually any size of superabrasive particle would be considered to be within the scope of the present invention, in one aspect the particles may range in size from about 100 to 350 micrometers. Additionally, superabrasive particles can be oriented in various directions relative to the pad, and there are three major orientations or attitudes that may affect the particle's cutting or grooming behavior. These attitudes expose either an apex, an edge, or a face of the superabrasive particle towards a CMP pad being dressed.

Orienting the superabrasive particles in a specific attitude in relation to the CMP pad to be dressed creates different asperities in the pad surface, thus altering the performance of the CMP pad. Different asperities retain slurry in different manners and thus polish a wafer or other work piece differently according to asperity depth, width, density, etc. The superabrasive particles of a CMP pad dresser can thus be oriented according to the desired polishing characteristics of the CMP pad. For example, if the superabrasive particles predominantly have an apex oriented towards the CMP pad, the asperities of the pad will be narrow and deep. The advantage of narrow and deep asperities is that the pad can better retain the polishing slurry, and thus the polishing rate of the wafer increases. However, the increased polishing rate may also increase the wear rate of the superabrasive particles. As such, wear rate may vary considerably depending on the attitude of the superabrasive particles, and therefore, the orientation of each superabrasive particle may be considered when designing a device with desired performance characteristics. Generally speaking, superabrasive particle attitudes that provide higher dressing rates (i.e. deeper penetration into a pad) also wear particles out at a higher rate.

In contrast, if the superabrasive particles are oriented with a face towards the pad, the resulting asperities may polish at a lower rate. The face of the particle is generally thought to be more durable, but does not typically cut deep and narrow asperities in the pad, but rather asperities that are shallow and broad. Therefore the face portion of a particle will dress a CMP pad at a reduced rate compared to the apex portion of a particle, but the superabrasive particle will wear at a much lower rate.

The edge portions of a superabrasive particle have dressing and wear characteristics that are between those of the face and apex portions. It has been thought that if the edge portion is utilized to dress a CMP pad, the asperities are not as deep or narrow as those dressed with an apex portion, but may provide asperities having desirable intermediate characteristics. Further, the edge portion of the particle does not wear at such a high rate as that of an apex. Hence, a CMP pad dresser utilizing all or a portion of superabrasive particles having exposed edge portions may provide a number of advantages.

Additionally, particle placement and methods and materials for affixing superabrasive particles to a substrate in predetermined configurations, such as grid, may be found in U.S. Pat. No. 6,039,641, U.S. Pat. No. 6,286,498, U.S. Pat. No. 6,368,198, and Applicant's copending U.S. patent application Ser. No. 10/109,531 filed Mar. 27, 2002, each of which is incorporated herein by reference in their entirety.

The brazing alloy of the present invention may be provided as a thin sheet, powder, or continuous sheet of amorphous braze alloy. There are many ways that the brazing alloy can be provided in accordance with the present invention. For example, a brazing alloy powder can first be mixed with a suitable binder (typically organic) and a solvent that can dissolve the binder. This mixture is then blended to form a slurry or dough with a proper viscosity. In order to prevent the powder from agglomeration during the processing, a suitable wetting agent (e.g., menhaden oil, phosphate ester) may also be added. The slurry can then be poured onto a plastic tape and pulled underneath a blade or leveling device. By adjusting the gap between the blade and the tape, the slurry can be cast into a plate with the desired thickness. The tape casting method is a well-known method for making thin sheets out of powdered materials and works well with the method of the present invention. Superabrasive particles can subsequently be disposed on top of the tape casted slurry.

The brazing alloy may also be provided as a sheet of amorphous brazing alloy. The sheet of amorphous brazing alloy may be flexible or rigid and may be shaped based on the desired tool contours. This sheet of brazing alloy also aids in the even distribution of the braze over the surface of the tool. The sheet of brazing alloy contains no powder or binder, but rather is simply a homogenous braze composition. Amorphous brazing alloys have been found to be advantageous for use in the present invention, as they contain substantially no eutectic phases that melt incongruently when heated. Although precise alloy composition is difficult to ensure, the amorphous brazing alloy used in the present invention should exhibit a substantially congruent melting behavior over a relatively narrow temperature range. Thus, during the heating portion of the brazing process the alloy does not form grains or a crystalline phase in substantial quantities, i.e. via vitrification. Further, the melting behavior of the amorphous braze alloy is distinct from sintering which requires the reduction or elimination of voids between particles of alloy material which does not exist in the amorphous form of the alloy. However, the originally amorphous braze may form non-homogeneous phases during crystallization via the slower cooling process. Generally, amorphous alloys are formed by quickly quenching the liquid into a solid to avoid localized crystallization and variations in composition. Notably, in each of the processes recited herein, the brazing alloy may be presented as a sheet, film, or other punched out layer that corresponds to the desired tool segment shape.

Alternatively, a powdered brazing alloy can be mixed with a suitable binder and it's solvent to form a deformable cake. The cake can then be extruded through a die with a slit opening. The gap in the opening determines the thickness of the extruded plate. Alternatively, the material can also be drawn between two rollers with adjustable gap to form sheets with the right thickness.

In one aspect, the brazing alloy may be substantially free of zinc, lead, and tin. One commercially available powdered braze alloy, which is suitable for use with the present invention, is known by the trade name NICROBRAZ LM (7 wt % chromium, 3.1 wt % boron, 4.5 wt % silicon, 3.0 wt % iron, a maximum of 0.06 wt % carbon, and balance nickel). Other suitable alloys included copper, aluminum, and nickel alloys containing chromium, manganese, titanium, and silicon. In one aspect, the brazing alloy may include chromium. In another aspect, the brazing alloy may include a mixture of copper and manganese. In a further aspect, the brazing alloy can contain either nickel or copper as a major constituent. In an additional aspect, the amount of chromium, manganese, and silicon may be at least about 5 percent by weight. In another aspect, the alloy may include a mixture of copper and silicon. In yet another aspect, the alloy may include a mixture of aluminum and silicon. In a further aspect, the alloy may include a mixture of nickel and silicon. In another aspect, the alloy may include a mixture of copper and titanium.

Preferably, the diamond braze contains at least 3% by weight of a carbide forming member selected from the group consisting of chromium, manganese, silicon, titanium, and aluminum, and alloys and mixtures thereof. Additionally, the diamond braze should have a liquidus temperature of less than 1,100° C. to avoid damage to the diamond during the brazing process. One commercially available sheet of amorphous brazing alloy which melts at a sufficiently low temperature is an amorphous brazing alloy foil (MBF) manufactured by Honeywell having the NICROBRAZ LM composition. These foil sheets are about 0.001" thickness and typically melt at between about 1,010° C. and about 1,013° C.

The brazing process can also be carried out in a controlled atmosphere, such as under a vacuum, typically about $10^{-5}$ torr, an inert atmosphere (e.g., argon (Ar) or nitrogen ($N_2$)), or a reducing atmosphere (e.g., hydrogen ($H_2$)). Such atmospheres may increase the infiltration of the brazing alloy into the matrix support material, and therefore, enhance the diamond-braze and matrix-braze bonding.

Figure 3:
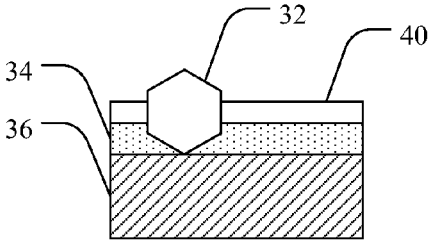
FIG. 3 is a side view of a superabrasive particle bonded to a braze layer in accordance with one embodiment of the present invention.

In some aspects of the present invention, an additional protective layer can be deposited onto the amorphous braze layer. As is shown in FIG. 3, a superabrasive particle 32 is embedded in an amorphous braze layer 34 resting on a substrate 36. A protective layer 40 is deposited on the amorphous braze layer 34. Such a protective layer can provide caustic protection to the underlying amorphous braze layer, as well as improving the retention of the superabrasive particles in the amorphous braze layer.

In one aspect of the present invention, the protective layer can be electrodeposited on the amorphous braze layer. A variety of materials are contemplated for use as a protective layer, however, in one aspect nickel is used. Additionally, the thickness of the protective layer can vary depending on the thickness of the amorphous braze layer and the working conditions of the tool. In one aspect, however, the amorphous braze layer and the protective layer have an additive thickness that is less than or equal to ¾ of the average diameter of the plurality of superabrasive particles. In another aspect, the amorphous braze layer and the protective layer have an additive thickness that is less than or equal to ½ of the average diameter of the plurality of superabrasive particles.

The substrate material can be any material that can support the superabrasive particles during use and that is capable of withstanding the brazing conditions. Thus the substrate of the various aspects of the present invention can be made of a metallic, a ceramic, a powder, or a metallic powder. One useful substrate material is stainless steel.

In another aspect of the invention it has been discovered that by orienting a majority, or in some cases most or substantially all, of the superabrasive particles with an edge, or in some aspects, other sharp point, as the working end (i.e. oriented toward the pad during a dressing operation) that the dressing rate of the CMP Pad dresser can be dramatically increased as compared to a dresser with the superabrasive particles randomly oriented or otherwise oriented. In some aspects, the dressing rate can be increased by at least a factor of 1. In other aspects, the dressing rate may be about double or greater. In yet other aspects, the dressing rate may be three or more times greater.

EXAMPLES

Example 1

150 microns sized diamond particles are glued onto an amorphous braze alloy (Metglass) of Ni—Cr—B—Si that is in turn glued onto a stainless steel substrate. The assembly is heated under vacuum to allow the diamond particles to sink and rotate into the amorphous braze alloy into an attitude that has a sharp portion oriented away from the substrate. The amorphous braze layer is allowed to cool to bond the diamond particles with the braze having a thickness less than 50 microns. The brazed diamond disk is electroplated with a layer of nickel to a thickness that is about half of the average diamond particle size. In order to prevent the over growth of nickel above the diamond particles, the brazed diamond is cleaned in hydrochloric acid to strip away adhered metal atoms on the diamond surface from metal vapor during brazing.

Example 2

Example 2 is the same as Example 1 except that a stainless steel mesh is glued on the amorphous braze alloy beforehand. The spreading of the diamond particles on the mesh can allow spacing of diamonds in a predetermined pattern. The excess diamond particles are poured off, leaving diamonds in a grid pattern. The holes of the mesh are about ⅓ to ½ of the diamond size, and therefore the diamond particles tend to orient with a tip down toward the amorphous braze layer. After the brazing, the mesh is fully bonded on the substrate and thus supports the diamond particles in the mesh holes. The assembly is then acid treated and electroplated as before.

Example 3

Example 3 is the same as Example 2, except the amorphous braze alloy is replaced with a bronze sheet (Cu—Sn) and the diamond particles are Ti coated. During the brazing process, the bronze braze will alloy with the Ti that forms carbide with diamond. This process can be performed at a much lower temperature (e.g. 700-800 C) compared with nickel alloy of AA (900-1000 C). The lower temperature can thus maintain the integrity of the diamond crystals that can be deteriorated by the included catalyst (Fe—Ni) at high temperature.

Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function, manner of operation, assembly, and use may be made without departing from the principles and concepts set forth herein.

The invention claimed is:

1. A method for orienting superabrasive particles in a tool, comprising:

providing a plurality of superabrasive particles having a preselected average size;

preselecting a thickness for an amorphous braze layer to be applied to a substrate, wherein the thickness is based on the average size of the plurality of superabrasive particles;

applying an amorphous braze layer to the substrate at the preselected thickness;

dispersing the plurality of superabrasive particles onto the amorphous braze layer;

melting the amorphous braze layer to cause the plurality of superabrasive particles to rotate and sink into the amorphous braze layer, wherein the thickness of the amorphous braze layer is such that the rotation and sinking of the plurality of superabrasive particles is halted by the substrate in an attitude whereby substantially all working ends of the plurality of superabrasive particles are sharp portions; and cooling the amorphous braze layer.

2. The method of claim 1, wherein the thickness of the amorphous braze layer is less than ⅓ the average diameter of the plurality of superabrasive particles.

3. The method of claim 2, wherein the thickness of the amorphous braze layer is greater than ⅕ the average diameter of the plurality of superabrasive particles.

4. The method of claim 1, further comprising electrodepositing protective layer on the amorphous braze layer.

5. The method of claim 4, wherein the amorphous braze layer and the protective layer have an additive thickness that is less than or equal to ¾ of the average diameter of the plurality of superabrasive particles.

6. The method of claim 4, wherein the amorphous braze layer and the protective layer have an additive thickness that is less than or equal to ½ of the average diameter of the plurality of superabrasive particles.

7. The method of claim 4, wherein the protective layer is nickel.

8. The method of claim 1, further comprising arranging the plurality of superabrasive particles in a predetermined pattern.

9. The method of claim 8, wherein the predetermined pattern is a grid.

10. A superabrasive tool, comprising:

a substrate; and a plurality of superabrasive particles oriented and bonded to the substrate with an amorphous braze layer as in claim 1, wherein substantially all of the plurality of superabrasive particles has an attitude whereby working ends of the plurality of superabrasive particles are sharp portions.

11. The tool of claim 10, wherein the thickness of the amorphous braze layer is greater than ⅓ of an average diameter of the plurality of superabrasive particles.

12. The tool of claim 10, wherein the thickness of the amorphous braze layer is greater than ⅕ of an average diameter of the plurality of superabrasive particles.

13. The tool of claim 10, wherein the plurality of superabrasive particles includes members selected from a group consisting of: diamond, polycrystalline diamond (PCD), cubic boron nitride (cBN), polycrystalline cubic boron nitride (PCBN), and combinations thereof.

14. The tool of claim 10, wherein the plurality of superabrasive particles includes diamond.

15. The tool of claim 10, further comprising a protective layer deposited on the amorphous braze layer.

16. The tool of claim 15, wherein the protective layer is nickel.

17. The tool of claim 15, wherein the amorphous braze layer and the protective layer have an additive thickness that is less than or equal to ¾ of the average diameter of the plurality of superabrasive particles.

18. The tool of claim 15, wherein the amorphous braze layer and the protective layer have an additive thickness that is less than or equal to ½ of the average diameter of the plurality of superabrasive particles.

19. The tool of claim 10, wherein substantially all of the plurality of superabrasive particles are configured in an attitude having an apex portion oriented away from the substrate.

20. The tool of claim 10, wherein substantially all of the plurality of superabrasive particles are configured in an attitude having an edge portion oriented away from the substrate.

* * * * *